US009441406B2

(12) United States Patent
Reid et al.

(10) Patent No.: US 9,441,406 B2
(45) Date of Patent: Sep. 13, 2016

(54) DOOR CLOSER

(75) Inventors: Peter Alister Reid, London (GB); Phillip Gallagher, Wigan (GB)

(73) Assignee: Astra Door Controls Limited (GB)

( * ) Notice: Subject to any disclaimer, the term of this patent is extended or adjusted under 35 U.S.C. 154(b) by 69 days.

(21) Appl. No.: 13/502,469

(22) PCT Filed: Oct. 27, 2010

(86) PCT No.: PCT/EP2010/066225

§ 371 (c)(1),
(2), (4) Date: Apr. 17, 2012

(87) PCT Pub. No.: WO2011/051317

PCT Pub. Date: May 5, 2011

(65) Prior Publication Data

US 2012/0198654 A1 Aug. 9, 2012

(30) Foreign Application Priority Data

Oct. 30, 2009 (GB) ..... 0918997.8

(51) Int. Cl.
*E05F 3/10* (2006.01)
*E05F 3/12* (2006.01)

(52) U.S. Cl.
CPC ..... *E05F 3/108* (2013.01); *E05F 3/12* (2013.01); *E05Y 2900/132* (2013.01); *Y10T 16/2766* (2015.01)

(58) Field of Classification Search
CPC ..... E05F 3/10; E05F 3/108; E05F 3/12
USPC ..... 16/52, 56, 57, 58
See application file for complete search history.

(56) References Cited

U.S. PATENT DOCUMENTS 3,781,943 A 1/1974 Cain
4,817,238 A * 4/1989 Liu ..... 16/66

(Continued)

FOREIGN PATENT DOCUMENTS

GB 1263666 2/1972
GB 2441893 3/2008

(Continued)

OTHER PUBLICATIONS

GB Search Report for GB Application No. 0918997.8 mailed on Feb. 17, 2010.
PCT International Search Report and Written Opinion for PCT/EP2010/066225 mailed on Jan. 20, 2011.

*Primary Examiner* — Emily Morgan
(74) *Attorney, Agent, or Firm* — Colin P. Cahoon; Shaukal A. Karjeker; Carstens & Cahoon, LLP

(57) ABSTRACT

A door closer components include a housing having a mounting plate, a tension member extending longitudinally within the central bore of the housing, a movable body within the housing connected to the tension member, a spring within the housing, and a hydraulic assembly for hydraulically controlling the longitudinal movement of the movable body. The hydraulic assembly is disposed within the central bore of the housing and includes a piston coupled to the housing and slidable in a fluid-filled chamber within the movable body, wherein the piston divides the chamber into two compartments. The piston has a valve mechanism which opens to permit relatively free movement of the fluid from one compartment to the other when the movable body is moved. The valve mechanism of the piston includes a boss fitted to a piston shaft and defining an annular sealing face and a longitudinally extending channel member integral with the boss.

13 Claims, 4 Drawing Sheets

(56) References Cited

U.S. PATENT DOCUMENTS

| | | | | |
|---|---|---|---|---|
| 4,991,255 | A * | 2/1991 | Liu | 16/70 |
| 5,170,530 | A * | 12/1992 | Kopec et al. | 16/52 |
| 5,414,894 | A * | 5/1995 | Fayngersh | 16/52 |
| 7,845,050 | B2 * | 12/2010 | Pyo | 16/85 |
| 2003/0110589 | A1 * | 6/2003 | Lin | 16/66 |
| 2009/0139049 | A1 * | 6/2009 | Bantle et al. | 16/84 |
| 2009/0241287 | A1 * | 10/2009 | Reid et al. | 16/58 |

FOREIGN PATENT DOCUMENTS

| | | | | |
|---|---|---|---|---|
| GB | 2441894 | 3/2008 | | |
| WO | WO2005/124079 | * 12/2005 | | E05F 3/22 |
| WO | 2008/102115 | 8/2008 | | |
| WO | WO2008/102115 | * 8/2008 | | E05F 3/10 |

* cited by examiner

DOOR CLOSER

BACKGROUND OF INVENTION

This invention relates to a door closing device for urging an opened door towards its closed position relative to a doorframe.

More particularly, the invention concerns improvements in a door closer, which is of the kind that usually acts between a door leaf and a doorframe. This type of door closer typically comprises a housing, a plunger movable along the housing, a biasing element disposed in the housing and biasing the plunger inwardly of the housing, and a tension member having one end connected to the plunger and another end, which extends to an anchor element. The housing is normally installed in a bore in the door leaf and the anchor element installed in the doorframe. However, the positions of the housing and the anchor element may be reversed. The biasing element comprises a spring, which operates to bias the plunger, and consequently the tension member, inwardly of the housing, for closing the door. The tension member comprises an articulated element so that the tension member can be bent around the opening angle of the door relative to the door frame.

It is known to provide such concealed door closers with a hydraulic damping assembly, as disclosed for example in GB-A-2441893, GB-A-2441894, WO-A-2005/124079 and WO-A-2008/102115. The hydraulic damping assembly comprises a piston and cylinder assembly that can damp the movement of the plunger. The hydraulic damping assembly comprises circuit for the hydraulic fluid that incorporates an adjustable valve assembly. The valve can be adjusted to vary the damping force of the hydraulic damping assembly.

Recently, a standard classifying controlled door closing devices has been established as BS EN 1154 1997, with Amendment A1 2003. Door closers intended for use on fire resisting doors and smoke control doors are covered by a Construction Products Directive mandate issued by the European Commission, and the Amendment A1 to the BS EN 1154 1997 harmonised the standard in compliance with the Directive and allows application of the CE mark. The standard sets minimum performance parameters for door closer operation, in particular with regard to closing moment (dependent on door size and mass) and closing time.

While face fixed overhead closers can readily be constructed so as to comply with BS EN 1154 1997, because a bulky housing can be provided which merely needs to fit to the door face or the frame, in contrast concealed door closers of the type disclosed in EP-A-0016445 generally cannot, primarily as a result of the inherently low power characteristics of this construction, because the spring needs to be dimensioned to fit within the door leaf without compromising the structural integrity of the door, which is crucial for fire resisting doors, for example.

There is a need in the art for concealed door closers that can comply with BS EN 1154 1997.

There is also a general need for such concealed door closers to have a structure to enable them to be incorporated into a variety of different door constructions having a variety of different uses. For example, the British Standard BS.EN 1154, and its equivalent European Standard EN 1154, sets (among others) a technical criterion required to be met by door closers, concealed or not, which is that the door closer must have a minimum opening/closing efficiency—the closer must provide a minimum resistance force in an opening direction, to enable a person readily to be able to pull open the door, but must provide a maximum closing force, to enable the door reliably to be closed under the action of the door closer, overcoming any resistance from the door latch, in order to ensure that the door closer can properly and promptly act to close the door, which provides safety in the event of a fire.

We have found that for concealed door closers incorporating a hydraulic damping assembly this demanding performance criterion is difficult to meet because the door closer can suffer from inadvertent jamming, and because it is necessary to ensure that the door closes completely, which means a reliable high closing force right at the end of the closing stroke to overcame any resistance to closing from the latch mechanism for the door.

Even for non-concealed "up and over" door closers, the efficiency can be quite low, for example 60 to 70%.

In addition, the fitting of concealed door closers even by professional workers such as builders, joiners, etc. can be rather problematic. The door closer incorporates a mechanical spring having a high spring constant, which applies a very high tensile restoring force to pull together the two parts of the door closer which are fitted to the door frame and to the door leaf. These parts need to be separate during installation. Furthermore, sometimes the door closer maybe inadvertently fitted incorrectly, for example "inside out" with the tensioning member between the two parts having the edge that should be oriented on the radially inside side of the closing arc being located o the radially outside edge. Although a fitting tool is disclosed in WO-A-2008/102115 to assist installation, there is still a need for an "idiot proof" fitting tool to ensure that the door closer is correctly fitted in the required orientation.

SUMMARY OF THE INVENTION

The present invention at least partially aims to overcome the problems of the known door closers described hereinabove. The present invention aims in particular to provide a concealed door closer having a high efficiency, and an improved fitting tool.

Accordingly, the present invention provides a door closer comprising: (a) a housing for fitting into a door, the housing having a mounting plate with an opening adjacent to a central bore of the housing; (b) a tension member extending longitudinally within the central bore of the housing and extending outwardly of the housing through the opening to define an end thereof for fitting to a door frame; (c) a movable body within the housing and adapted for longitudinal movement within the central bore, the movable body being connected to the tension member; (d) a spring within the housing and biasing the movable body in a first direction away from the mounting plate so as to urge the tension member inwardly of the housing in a door closing motion; (e) a hydraulic assembly for hydraulically controlling the longitudinal movement of the movable body, the hydraulic assembly being disposed within the central bore of the housing; wherein the hydraulic assembly comprises a piston coupled to the housing and slidable in a fluid-filled chamber within the movable body, wherein the piston divides the chamber into two compartments, and the piston comprises a valve mechanism which opens to permit relatively free movement of the fluid from one compartment to the other when the movable body is moved relative to the piston in a second direction, opposite to the first direction, in response to movement of the tension member outwardly of the housing but closes to present resistance to movement of the movable body in the first direction, wherein the valve mechanism of the piston comprises a boss fitted to a piston shaft and defining an annular sealing face, a longitudinally extending channel member integral with the boss, the channel member having at least one longitudinal channel therein which terminates at a closed end near to but spaced from the annular sealing face, an annular seal member fitted around the channel member, the annular seal member being disposed for longitudinal sliding motion on the channel member, between sealed and unsealed positions, the at least one longitudinal channel extending between opposite sides of the annular seal member, the seal member having an annular end sealing surface facing the boss, and a circumferentially outer surface of the annular seal member providing a sealing engagement with the movable body.

The door closer may further comprise an annular washer slidably fitted around the channel member between the boss and the annular seal member, the washer having a thickness greater than the distance of the closed end from the annular sealing face.

Typically, in the sealed position the washer abuts the boss and the annular seal member abuts the washer, the washer covering the or each closed end to prevent fluid movement though the at least one channel.

Typically, in the unsealed position the washer is spaced from the boss to expose the or each closed end to permit fluid movement though the at least one channel and through a central opening in the annular seal member.

Preferably, the valve mechanism of the piston further comprises a disc having at least one fluid conduit extending longitudinally therethrough, the disc being fitted to the piston shaft adjacent to the annular seal member.

Preferably, the annular sealing face of the boss is provided with at least one through-hole extending through the boss.

Preferably, the fluid-filled chamber comprises an first elongate chamber within which the piston slides and a second elongate chamber in fluid communication therewith via an adjuster for adjusting a damping action of the hydraulic assembly in a door closing motion, the adjuster being located at one end of the fluid-filled chamber, and via at least one fluid return port, located at an opposite end of the fluid-filled chamber.

More preferably, the second elongate chamber is annular and surrounds the first elongate chamber which is cylindrical.

Optionally, the adjuster of the hydraulic assembly, for adjusting the damping rate of the longitudinal movement of the movable body at least in the first direction, comprises a rotatable threaded valve member of a fluid bypass valve located at an end of the hydraulic assembly which faces the opening in the mounting plate, and an end member for retaining the valve member captive in the adjuster.

The present invention further provides a kit of parts for fitting a door closer, the kit comprising a door closer according to the present invention in combination with a fitting tool, the fitting tool comprise a U-shaped body with two parallel legs extending away from a base and with a central elongate linear slot, open at one end, between the two legs, and the rigid tension member is received in the slot to retain the rigid tension member partly out of the housing, and the fitting tool further comprises an orienting guide part extending orthogonally away from the base.

Preferably, the orienting guide part is remote from the legs so that the fitting tool has an L-shape.

Preferably, the rigid tension member is retained partly out of the housing to permit the housing and the mounting member of the door closer to be oriented at a desired angular relationship during installation of the door closer.

Preferably, the central portion of the rigid tension member is received in the slot and an enlarged portion of the second end bears against an end face of the U-shaped body.

Typically, the body comprises a rigid plate member having opposite parallel end faces which are orthogonal to the through-direction of the slot, and the orienting guide part is a rigid plate member integral with the body.

BRIEF DESCRIPTION OF THE DRAWINGS

Embodiments of the present invention will now be described by way of example only with reference to the accompanying drawings, in which:

FIGS. 1 to 5 show a door closer according to the present invention that can be used for urging an opened door towards its closed position relative to a door frame;

DETAILED DESCRIPTION

Figure 1:
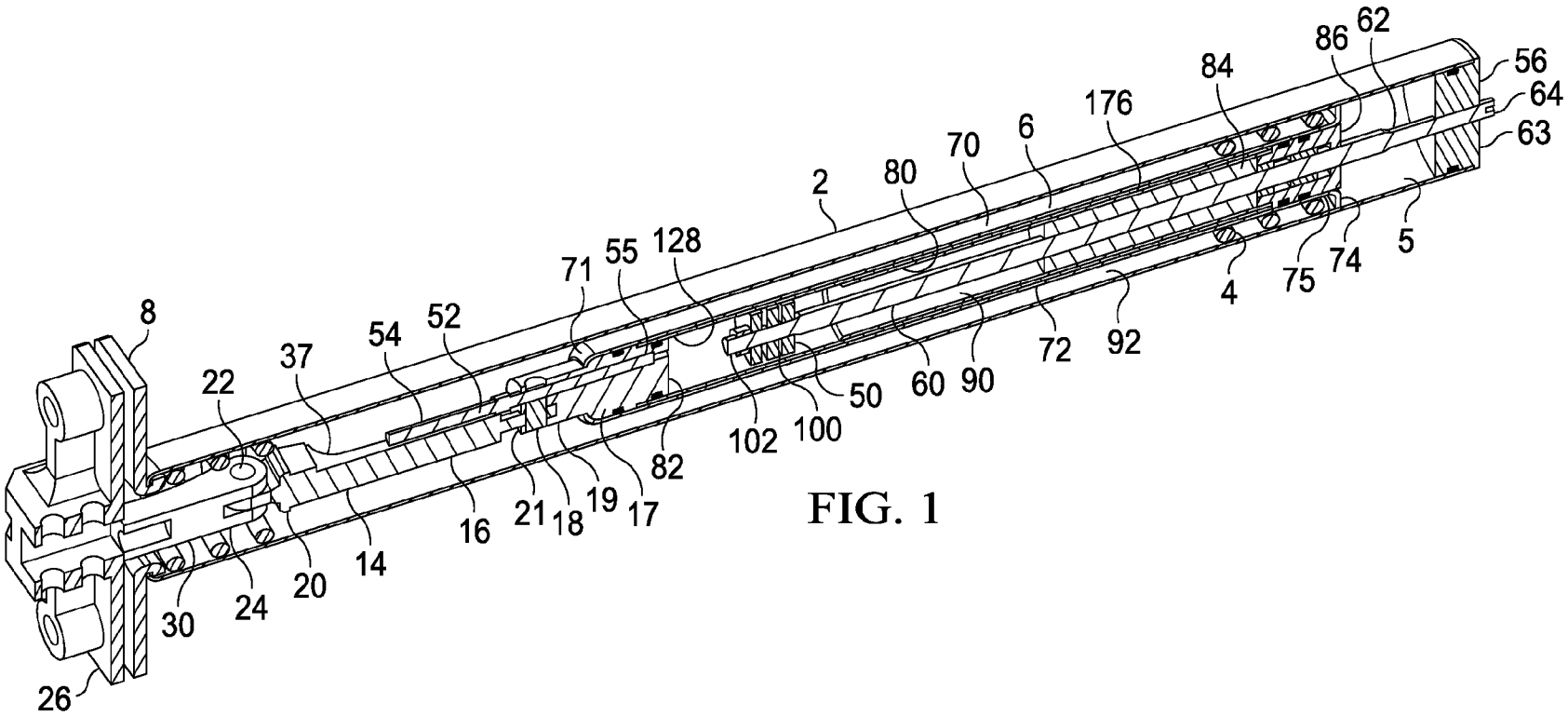
FIG. 1 is a partly cut-away perspective side view of a door closer according to an embodiment of the present invention in a closed configuration.
Figure 2:
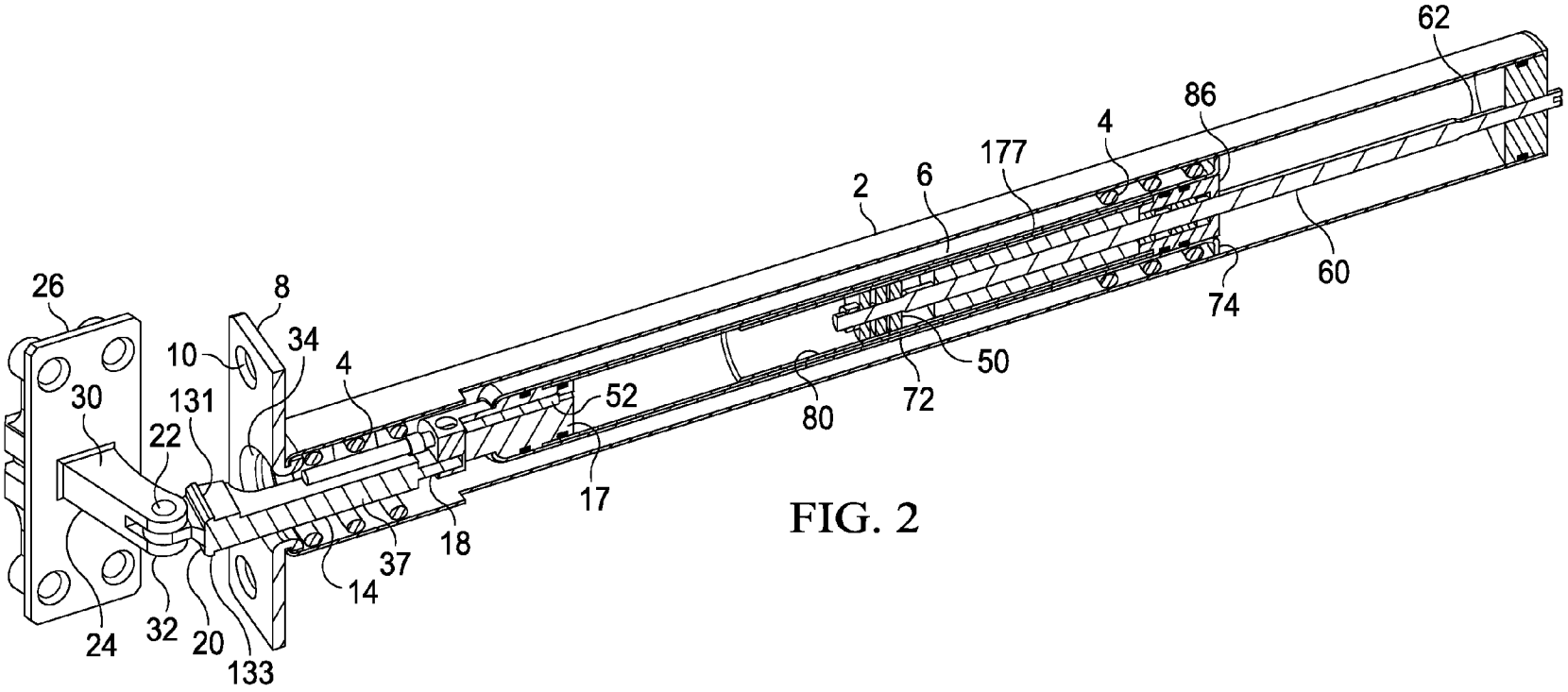
FIG. 2 is a partly cut-away perspective side view of the door closer of FIG. 1 in an open configuration.

An elongate housing 2 in the form of a cylindrical tube comprises a biasing element 4 in the form of a helical compression spring 4. In FIGS. 1 and 2, for clarity of illustration only the opposed ends of the helical compression spring 4 are shown and the central portion is not shown. A plunger 6 is disposed in and movable along the housing 2. The plunger 6 is biased inwardly of the housing 2 by the biasing element 4. The helical compression spring 4 annularly surrounds the plunger 6. The housing 2 has a mounting plate 8 affixed thereto, the mounting plate 8 having holes 10 extending therethrough for receiving fixing screws. In use, the housing 2 is received in an elongate horizontal cavity in a door leaf (not shown), and the mounting plate 8 is rebated into the edge of the door leaf and affixed thereto, for example by screws.

A rigid tension member 14 has a first end 16 pivotally connected at a first pivot 18 to a plunger head 17 of the plunger 6 and a second end 20 pivotally connected at a second pivot 22 to an anchor element assembly 24. The first pivot 18 has a knurled outer cylindrical surface 19 securely fitting into a cylindrical hole 21 in the plunger head 17, the knurling preventing inadvertent removal of the first pivot 18. The anchor element assembly 24 comprises a mounting member 26, in the form of a plate, for mounting in a door frame (not shown) and an elongate link member 30 extending from the mounting member 26. The mounting member 26 is typically rebated into the edge of the door frame and affixed thereto, for example by screws. The second pivot 22 is located at a free end 32 of the link member 30 remote from the plate member 26. The first and second pivots 18, 22 have parallel axes 19, 23.

Conceivably, the mounting positions of the housing 2 and the anchor element assembly 24 may be reversed, with the housing 2 received in the door frame and the anchor element assembly 24 mounted to the door leaf.

A hole 34 in the mounting plate 8 permits movement therethrough of the rigid tension member 14 and the link member 30.

The rigid tension member 14 comprises a linearly straight body that has a laterally offset reduced thickness central portion 37 between the first and second ends 16, 20.

The door closer of the invention also incorporates an adjustable damper to provide a decelerated or damped closing action.

In the illustrated embodiment a hydraulic cylinder/piston damper 50 for damping the movement of the plunger 6 within the housing 2, having the general structure as disclosed for example in WO-A-2005/124079, is provided. The hydraulic cylinder/piston damper 50 has a threaded adjuster pin 52 for adjusting the operation of the hydraulic damper 50. The threaded adjuster pin 52 is mounted in the plunger head 17 of the plunger 6 adjacent the first pivot 18 and has an elongate head 54 which extends away from the plunger 6 and lies adjacent to the rigid tension member 14. At the other end of the threaded adjuster pin 52 a needle valve member 55 of a restrictor valve is provided which is employed to adjust the flow of hydraulic fluid in the damper 50. The hole 34 permits insertion therethrough of a screwdriver or other tool to adjust the threaded adjuster pin 52.

At the other end of the housing 2 a cylindrical end piece 56 is fitted into the housing 2 so as to close off the bore 5 defined by the housing 2. A piston shaft, hereinafter referred to as a plunger shaft 60, is fitted to the end piece 56 and extends axially along a portion of the bore 5, typically about one half of the length of the bore 5. A reduced diameter portion 62 of the plunger shaft 60 extends through a hole 63 in the end piece 56, and a lock nut 64 is threaded onto an end of the plunger shaft 60 on the exposed face of the end piece 56. This arrangement permits the longitudinal position of the plunger shaft 60 in the bore 5 to be adjusted over a small distance after manufacture and assembly of the door closer by turning the lock nut 64.

The closed door position is shown in FIG. 1. The mounting plate 8 and the plate member 26 abut. The rigid tension member 14 is wholly received in the housing 2, and the link member 30 is also received in the housing 2. The helical compression spring 4 has urged the plunger 6 to its most inward position with respect to the housing 2.

When the door leaf is opened relative to the door frame about the axis of one or more door hinges (not shown), the plunger 6, being attached to the door frame, is pulled in a direction outwardly of the housing 2. Accordingly, the helical compression spring 4 is progressively compressed, as a result of a compression force acting thereon by the plunger 6, and exerts an inward biasing force acting against the opening pulling force on the door leaf. The open position is shown in FIG. 2. The mounting plate 8 is spaced from the plate member 26. The link member 30 is pulled out of the housing 2 and the rigid tension member 14 is partly received in the housing 2. The rigid tension member 14 is rotated relative to the plunger 6 about the first pivot 18. The link member 30 is rotated relative to the rigid tension member 14 about the second pivot 22.

In the fully open position, in which the door leaf has been opened by an angle of up to 120°, the rigid tension member 14 is pulled completely out of the housing 2 and the first pivot 18 and the associated end of the plunger 6 are disposed at the hole 34. The rigid tension member 14 has been rotated relative to the plunger 6 about the first pivot 18 so as to lie, in the fully open position, at an angle of up to about 120° relative to the longitudinal axis of the door closer 2. The link member 30 has been rotated relative to the rigid tension member 14 about the second pivot 22.

After the door leaf is released, the biasing force of the helical compression spring 4 acts to bias the rigid tension member 14 inwardly of the housing 2, for closing the door. The damper may provide a reduced damping force at the end of the closing operation so as to provide an enhanced closing velocity for overcoming any latch resistance so that the door is securely latched when closed.

The structure and operation of the hydraulic damping assembly will now be described.

A hydraulic damper assembly 70 is mounted on the plunger shaft 60 for sliding movement therealong. The hydraulic damper assembly 70 includes an outer tube 72 which extends axially along a portion of the bore 5, typically about one half of the length of the bore 5. The outer tube 72 has an integral radially outwardly directed flange 74 at one end 75 thereof that is towards the end piece 56. The flange 74 and the mounting plate 8 define opposed bearing surfaces against which the opposed ends of a helical compression spring 4 are seated. The helical compression spring 4 surrounds the outer tube 72 and outer tube 72 is free to move along the bore 5 within the internal diameter of the helical compression spring 4 as the spring 4 is progressively compressed or expanded.

At the other end of the outer tube 72 the end edge 71 is crimped radially inwardly to support the plunger head 17 that is fitted within the outer tube 72.

An inner tube 80 is disposed coaxially within the outer tube 72. One end 82 of the inner tube 80 is fitted, in a fluid-tight manner to the plunger head 17 and another end 84 is fitted to a plunger shaft housing 86 which surrounds the plunger shaft 60. The adjacent end 75 of the outer tube 72 is also fitted to the plunger shaft housing 86.

The inner tube 80, plunger head 17 and the plunger shaft housing 86 define an inner chamber 90 through which the plunger shaft 60 extends. An outer chamber 92 is defined between the outer tube 72 and the inner tube 80. At the plunger head 17 the inner chamber 90 and the outer chamber 92 communicate via the restrictor valve comprising the needle valve member 55. At the plunger shaft housing 86 the inner chamber 90 and the outer chamber 92 communicate via at least one port (not shown) in the plunger shaft housing 86. This structure forms a hydraulic circuit connecting the inner and outer chambers 90, 92. The inner chamber 90 and the outer chamber 92 are filled with a hydraulic fluid, such as an oil or ethylene glycol.

The restrictor valve can regulate the flow of hydraulic fluid from the inner chamber 90 to the outer chamber 92, and thereby control the degree of damping of the hydraulic damping assembly.

An accumulator 176 comprises an elongate annular foam member which is disposed in the inner chamber 90 adjacent to the plunger shaft housing 86 and surrounds the plunger shaft 60. The accumulator 176 comprises a body of foamed plastics or rubber material, comprising a closed cell foam structure, such as neoprene. The accumulator 176 is spaced from the plunger boss 104 by at least one rigid spacer 177, e.g. of nylon, which prevents trapping of the accumulator 176 in any gap between the plunger boss 104 and the inner tube 80.

A piston, referred to hereinafter as a plunger valve assembly 100, is shown in detail in FIGS. 3 to 5.

Figure 3:
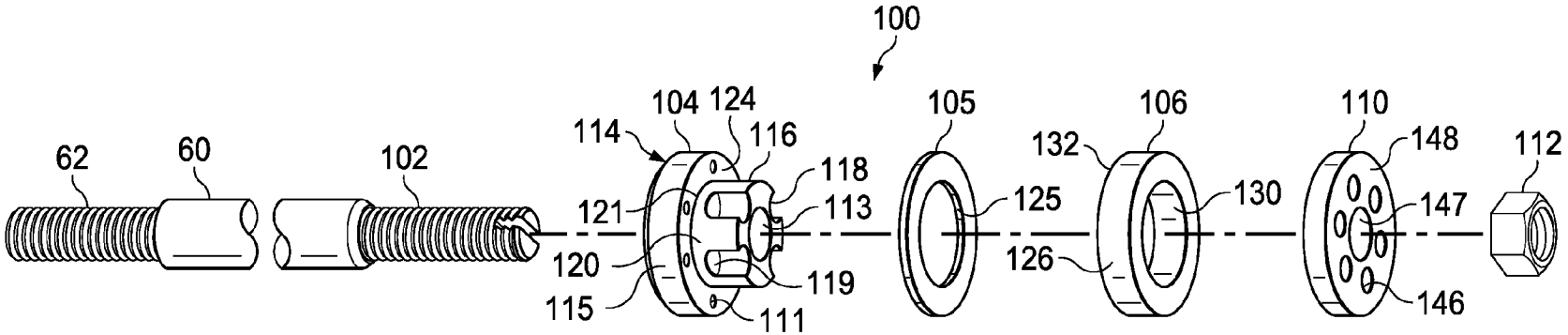
FIG. 3 shows an exploded perspective view of the plunger valve assembly of the door closer of FIG. 1.

Referring in particular to FIG. 3, the plunger shaft 60 is provided at its end thereof which is remote from the reduced diameter portion 62 fitted into the end piece 56 with a second reduced diameter portion 102 on which a plunger valve assembly 100 is mounted. The plunger valve assembly 100 comprises, in turn, a plunger boss 104 fitted onto the second reduced diameter portion 102, a plunger washer 105 fitted onto the plunger boss 104, a plunger seal 106 fitted onto the plunger boss 104, a plunger fluid flow plate 110 fitted onto the second reduced diameter portion 102, and a lock nut 112, threaded onto the end of the second reduced diameter portion 102 so as to secure the plunger valve assembly 100 on the plunger shaft 60.

The plunger boss 104 and plunger fluid flow plate 110 are prevented against longitudinal movement along the plunger shaft 60 by the lock nut 112. However, as described in detail hereinafter, the plunger washer 105 and the plunger seal 106 are mounted on the plunger boss 104 and have a limited range of longitudinal movement. Movement of the plunger seal 106 causes opening or closing of the plunger valve assembly 100.

The plunger boss 104 has a central hole 113 through which the second reduced diameter portion 102 of the plunger shaft 60 extends. The plunger boss 104 comprises a large diameter end wall 114 whose external diameter, defined by an outer circumferential surface 115 is slightly less than the internal diameter of the inner tube 80. Plural through-holes 111 extend through the end wall 114. A channel body 116 of the plunger boss 104, integral with the end wall 114, has a reduced diameter as compared to the end wall 114. The channel body 116 is substantially cylindrical but includes a plurality, in the embodiment four, longitudinally directed channels 118 formed in its outer circumferential surface 120. The channels 118 are substantially semicircular in cross-section and are equidistant around the circumferential surface 120. The channels 118 each terminate at a closed end 119 located at a position a short distance x (e.g. about 0.5 mm) remote from the end face 124 of the end wall 114. The closed end 119 is thus near to but spaced from the end face 124 (which is annular and acts a s a seal) of the end wall 114. A junction 121 of the end face 124 and the circumferential surface 120 is spaced from both the closed ends 119 and the through-holes 111, so that when the plunger washer 105 abuts the end face 124, a seal is formed therebetween.

The plunger washer 105 is typically composed of metal and is an annular ring of the same external diameter as the end wall 114 and a thickness greater than the distance x of the closed ends 119 from the end face 124. The internal circumferential surface 125 of the plunger seal 106 is slidably fitted on the outer circumferential surface 120 of the channel body 116 of the plunger boss 104 and can move longitudinally thereto. Accordingly, when the plunger washer 105 is slid into a position to the left as shown in FIG. 3 and therefore abuts the end face 124, the washer 105 covers the closed ends 119 of the channels 118 and there is little or no possibility of hydraulic fluid flow from the channels 118 towards the end face 124 because the washer 105 closes off the ends 119 of the channels 118.

The plunger seal 106 comprises an annular body of plastics or rubber material, and has an external diameter which is substantially the same as the internal diameter of the inner tube 80 so that when the plunger seal 106 is received in the inner tube 80, there is a fluid tight seal between the outer circumferential surface 126 of the plunger seal 106 and the internal surface 128 of the inner tube 80. The internal circumferential surface 130 of the plunger seal 106 is slidably fitted on the outer circumferential surface 120 of the channel body 116 of the plunger boss 104 and can move longitudinally thereto. The annular end face 132 of the plunger seal 106 facing towards the washer 105 constitutes a sealing face which seals against the washer 105 which in turn is urged against the end wall 114 which acts as a seat for the washer 105 which in turn acts as a seat for the plunger seal 106.

The plunger fluid flow plate 110 comprises an annular metal disc 148 having a central opening 147 for receiving the second reduced diameter portion 102 of the plunger shaft 20 and a plurality of, in the embodiment six, conduits 146 extending between the opposed annular faces of the disc 148. The conduits 146 are circumferentially equidistant and disposed in a satellite fashion around the central opening 147. The lock nut 112 secures the disc 148 to the plunger shaft 60 but leaves the conduits 146 at least partially exposed.

Figure 5:
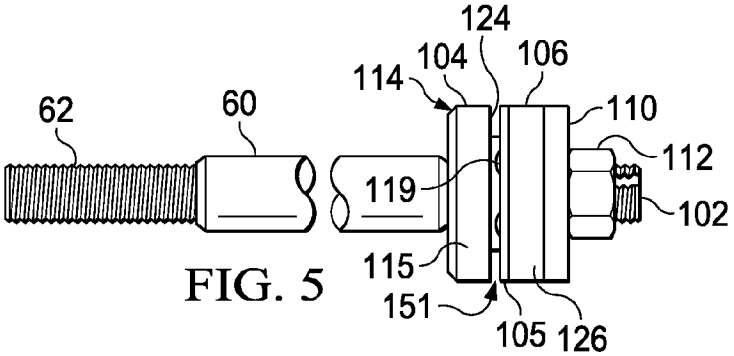
FIG. 5 shows a side view of the plunger valve assembly of the door closer of FIG. 1 in a second, open, configuration.
Figure 4:
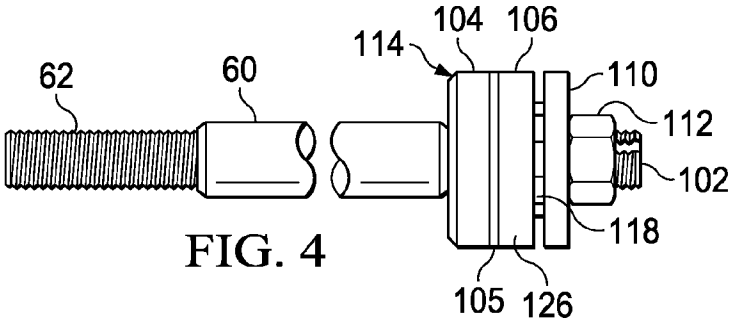
FIG. 4 shows a side view of the plunger valve assembly of the door closer of FIG. 1 in a first, closed, configuration.

The sealed position of the plunger valve assembly 100 is shown in FIG. 4 and the unsealed position is shown in FIG. 5.

In the sealed position of FIG. 4, which is achieved when the hydraulic fluid pressure acts in a direction from right to left in the drawing of FIG. 4 during closing of the door closer, in which the assembly of the outer and inner tubes 72, 80 moves to the right in FIG. 1 along the plunger shaft 60, the fluid pressure urges the plunger seal 106 against the washer 105 and the washer 105, in turn, against the end wall 114 of the plunger boss 104. Therefore, when the outer circumferential surface 126 of the plunger seal 106 is sealed against the inner circumferential surface 128 of the inner tube 80, hydraulic fluid within the inner chamber 90 on one side of the plunger seal 106 cannot flow to the other side of the plunger seal 106. By providing the washer 105 together with the closed ends 119 of the channels 118 being remote from the end face 124 of the end wall, this minimizes the possibility of hydraulic fluid being forced between the plunger seal 106 and the plunger boss 104 in the sealed position, which could otherwise cause inadvertent jamming of the plunger valve assembly 100. A highly efficient seal is provided in this configuration. The closing movement resulting from the spring bias is damped by the restrictor valve.

In FIG. 5 however, which shows the unsealed configuration, the plunger washer 105 and the plunger seal 106 has been urged by hydraulic pressure (in a right hand direction in FIG. 5) away from the end face 124 and towards the plunger fluid flow plate 110. This is achieved during opening of the door closer, in which the assembly of the outer and inner tubes 70, 80 moves to the left in FIG. 1 along the plunger shaft 60. With the outer circumferential surface 126 of the plunger seal 106 still sealed against the internal circumferential surface 128 of the inner tube 80, hydraulic fluid within the inner chamber 92 can flow through the plunger valve assembly 100. Hydraulic fluid can flow through the through-holes 111 and even to some extent over the outer circumferential surface 115 of the end wall 114, and then radially inwardly through the gap 151 between the end wall 114 and the plunger washer 105, into the now exposed closed ends 119 of the channels 118, longitudinally along the channels 118, radially outwardly under the fluid pressure so as the exit the channels 118 between the seal 106 and the fluid flow plate 110, and finally longitudinally through the conduits 146 in the plunger washer 110. There is substantially no seal at the plunger valve assembly 100 in this configuration. The opening movement, against the spring bias, is substantially unrestricted by the plunger valve assembly 100 and is not damped by the restrictor valve.

This seal accordingly has high efficiency, typically from 80 to 90% according to the test of BS EN 1154 1997, or even as high as 92%.

In a modification, the washer 105 may be omitted and the annular plunger seal 106 may be made correspondingly wider in a longitudinal direction so that it directly abuts the sealing end face 124 of the boss 104 in the sealed position.

Figure 6:
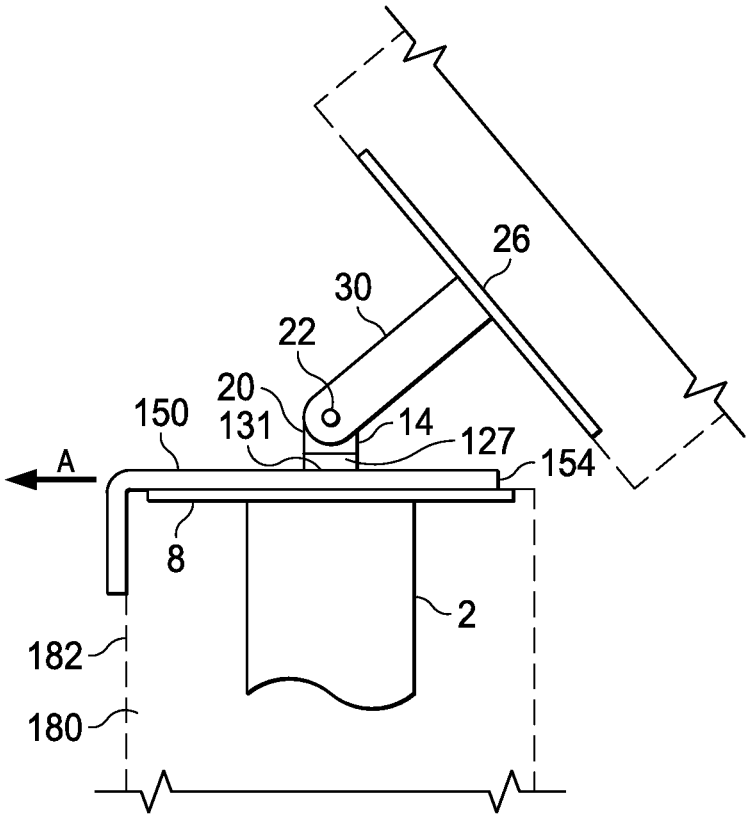
FIG. 6 shows a top view of the door closer of FIG. 1 prior to installation between a door leaf and a door frame, the door closer being in combination with a fitting tool according to another embodiment of the present invention.
Figure 7:
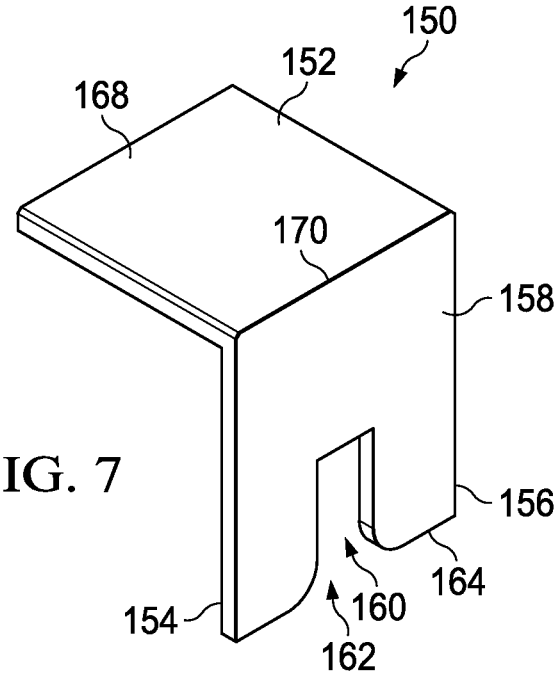
FIG. 7 shows a perspective side view of the fitting tool of FIG. 6.

FIG. 6 shows a top view of the door closer prior to installation between a door leaf and a door frame, the door closer being in combination with a fitting tool for retaining the tension member partly out of the housing, and in particular to permit the mounting plates of the door closer to be oriented at a desired angular relationship in a partly open condition during installation. FIG. 7 shows a perspective view of the fitting tool shown in FIG. 6.

The fitting tool 150 comprises a U-shaped body 152 with two parallel legs 154, 156 extending away from a base 158 and with a central elongate linear slot 160, open at one end 162, between the two legs 154, 156. The body 152 comprises a rigid plate member having opposite parallel end faces 164, 166 which are orthogonal to the through-direction of the slot 160. An integral orienting guide part 168 extends orthogonally away from the upper edge 170 of the body 152 remote from the legs 154, 156, so that the fitting tool 150 has an L-shape.

In use, the tension member 14 is received in the slot 160 to retain the tension member 14 partly out of the housing 2, and in particular to permit the mounting plate 8 and the mounting member 26 of the door closer to be oriented at a desired angular relationship in a partly open condition during installation. The second end 20 of the tension member 14 includes an enlarged portion 127 that is larger in height (i.e. a direction substantially parallel to the pivot axis of the second pivot 22) than the adjacent central portion 37 of the tension member 14. The enlarged portion 127 thereby provides (see also FIG. 2) a pair of upper and lower abutment surfaces 131, 133 of the tension member 14 facing rearwardly, i.e. back into the housing 2 and, when outside the housing 2, back towards the mounting plate 8.

The pair of upper and lower abutment surfaces 131, 133 of the tension member 14 is biased by the spring 4 in the housing 2 against the respective legs 154, 156 of the fitting tool 150. The securing of the fitting tool 150 between the mounting plate 8 and the enlarged portion 127 prevents the entire tension member 14 and the elongate link member 30 pivotally attached thereto from being pulled by the spring bias into the housing 2. The exposed part of the enlarged portion 127 and the elongate link member 30 are of sufficient length to permit sufficient angular separation between the mounting plate 8 and the door frame mounting member 26 to enable them readily to be fitted to the door leaf and the door frame respectively, for example using screws as discussed earlier.

Accordingly, the door closer is sold to the customer with the fitting tool 150 pre-fitted on the tension member 14. The installer offers the door closer up to the door leaf 180, shown in phantom in FIG. 5. The L-shape of the fitting tool provides a guide as to how the door closer must be oriented relative to the door leaf. The orienting guide part 168 can only be fitted on the side of the door leaf remote from the hinge axis otherwise it would not be possible readily to remove the fitting tool after fitting of the door closer.

After fitting the door closer to the door leaf 180 and the door frame 184, also shown in phantom in FIG. 5, the fitting tool 150 is removed by horizontal sliding away (in the direction of arrow A in FIG. 5) from the tension member 14, permitting the door to be fully closed under the action of the installed door closer. The orienting guide part 168 must be placed against or spaced from the radially outer face 182 of the door leaf with respect to the hinge axis. Otherwise, it would not be possible easily to remove the fitting tool 150 after fitting the door closer to the door leaf and the door frame 184. Therefore the L-shaped structure of the fitting tool ensures that the door closer is correctly fitted in the correct orientation, and is not inadvertently fitted "inside-out" or "upside down" with respect to the hinge location and angular direction of operation of the door.

The present invention provides a concealed door closer that can comply with BS EN 1154 1997. The overall dimensions are compact, so that the door closer can be fitted within the door leaf without compromising the structural integrity of the door. However, the compression spring dimensions, and therefore spring force available for closing the door leaf, are sufficient to comply with BS EN 1154 1997. The damping assembly is not only compact, being disposed within the internal diameter of the compression spring, but also it is readily adjustable so that the closure period of the concealed door closer can be reliably controlled to be within the limits required by BS EN 1154 1997. Moreover, the damping characteristics of the concealed door closer can be adjusted after installation, in particular by a person other than a trained installer or engineer, without removal of the unit from the door leaf.

The invention claimed is:

1. A door closer comprising:

(a) a housing for fitting into a door, the housing having a mounting plate with an opening adjacent to a central bore of the housing;

(b) a tension member extending longitudinally within the central bore of the housing, the tension member having an end extending outwardly of the housing through the opening for fitting to a door frame;

(c) a movable body within the housing and adapted for longitudinal movement within the central bore, the movable body being connected to the tension member;

(d) a spring within the housing and biasing the movable body in a first direction away from the mounting plate so as to urge the tension member inwardly of the housing in a door closing motion;

(e) a hydraulic assembly configured to hydraulically control the longitudinal movement of the movable body, the hydraulic assembly being disposed within the central bore of the housing; wherein the hydraulic assembly comprises a piston coupled to the housing and slidable in a first fluid-filled chamber within the movable body, wherein the piston divides the first fluid-filled chamber into two compartments, and the piston comprises a valve mechanism which opens to permit relatively free movement of the fluid from one compartment to the other when the movable body is moved relative to the piston in a second direction, opposite to the first direction, in response to movement of the tension member outwardly of the housing but closes to present resistance to movement of the movable body in the first direction, wherein the valve mechanism of the piston comprises a boss fitted to a piston shaft and defining an annular sealing face, a longitudinally extending channel member integral with the boss, the channel member having at least one longitudinal channel therein which terminates at a closed end near to but spaced from the annular sealing face, an annular seal member fitted around the channel member, the annular seal member being disposed for longitudinal sliding motion on the channel member between sealed and unsealed positions, the at least one longitudinal channel extending between opposite sides of the annular seal member;

when in the sealed position, the annular seal member abuts the boss, the annular seal member covering the closed end to prevent fluid movement between the two compartments which minimizes the possibility of inadvertent jamming.

2. A door closer according to claim 1, the annular seal member further comprising a washer.

3. A door closer according to claim 1, wherein in the unsealed position, the annular seal member is spaced from the boss to expose the closed end to permit fluid movement through the at least one channel and through a central opening in the annular seal member.

4. A door closer according to claim 1 wherein the valve mechanism of the piston further comprises a disc having at least one fluid conduit extending longitudinally there through, the disc being fitted to the piston shaft adjacent to the annular seal member.

5. A door closer according to claim 1 wherein the annular sealing face of the boss is provided with at least one through-hole extending through the boss.

6. A door closer according to claim 1 further comprising a second elongate chamber in fluid communication with the first fluid-filled chamber via an adjuster operatively configured to adjust a damping action of the hydraulic assembly in a door closing motion, the adjuster being located at one end of the first fluid-filled chamber, and via at least one fluid return port, located at an opposite end of the first fluid-filled chamber.

7. A door closer according to claim 6 wherein the second elongate chamber is annular and surrounds the first fluid-filled chamber which is cylindrical.

8. A door closer according to claim 6 wherein the adjuster of the hydraulic assembly, for adjusting the damping rate of the longitudinal movement of the movable body at least in the first direction, comprises a valve member of a fluid bypass valve located at an end of the hydraulic assembly which faces the opening in the mounting plate, and an end member operatively configured to retain the valve member captive in the adjuster.

9. A kit of parts for fitting a door closer, the kit comprising a door closer according to claim 1 in combination with a fitting tool, the fitting tool comprise a U-shaped body with two parallel legs extending away from a base and with a central elongate linear slot, open at one end, between the two legs, and the tension member is received in the slot to retain the tension member partly out of the housing, and the fitting tool further comprises an orienting guide part extending orthogonally away from the base.

10. A kit of parts according to claim 9, wherein the orienting guide part is remote from the legs so that the fitting tool has an L-shape.

11. A kit of parts according to claim 9 wherein the rigid tension member is retained partly out of the housing to permit the housing and the mounting member of the door closer to be oriented at a desired angular relationship during installation of the door closer.

12. A kit of parts according to claim 11 wherein a central portion of the tension member is received in the slot and an enlarged portion of a second end of the tension member bears against an end face of the U-shaped body.

13. A kit of parts according to claim 9 wherein the body comprises a rigid plate member having opposite parallel end faces which are orthogonal to the through-direction of the slot, and the orienting guide part is a rigid plate member integral with the body.

* * * * *